US007771337B2

(12) United States Patent
White et al.

(10) Patent No.: US 7,771,337 B2
(45) Date of Patent: Aug. 10, 2010

(54) SELF-CENTERING TUCKER ASSEMBLY FOR A FOLDING ROLL

(75) Inventors: Barton J. White, Freedom, WI (US); Andrew L. Haasl, Green Bay, WI (US)

(73) Assignee: Fabio Perini S.p.A., Lucca (IT)

( * ) Notice: Subject to any disclaimer, the term of this patent is extended or adjusted under 35 U.S.C. 154(b) by 468 days.

(21) Appl. No.: 10/953,176

(22) Filed: Sep. 29, 2004

(65) Prior Publication Data

US 2005/0070417 A1 Mar. 31, 2005

Related U.S. Application Data

(60) Provisional application No. 60/507,403, filed on Sep. 30, 2003, provisional application No. 60/507,405, filed on Sep. 30, 2003.

(51) Int. Cl.
*B31F 1/10* (2006.01)
*B31F 1/00* (2006.01)

(52) U.S. Cl. ..... 493/445; 493/424

(58) Field of Classification Search ..... 493/343, 493/344, 360, 434, 435, 395, 416, 426, 428, 493/444, 445, 449
See application file for complete search history.

(56) References Cited

U.S. PATENT DOCUMENTS

| | | | | |
|---|---|---|---|---|
| 1,595,992 | A | 8/1926 | Cannard et al. | |
| 2,092,952 | A | 9/1937 | Campbell | |
| 3,124,349 | A | 3/1964 | Huffman | |
| 3,214,162 | A | 10/1965 | Breidenbach et al. | |
| 3,640,522 | A | 2/1972 | Oelmann et al. | |
| 3,986,711 | A | 10/1976 | Anikanov et al. | |
| 4,073,485 | A * | 2/1978 | Gregoire et al. | 493/353 |
| 4,265,438 | A | 5/1981 | Lanvin | |
| 4,270,744 | A * | 6/1981 | Trogan | 493/430 |
| 4,493,690 | A * | 1/1985 | Niemiro et al. | 493/444 |
| 4,519,596 | A | 5/1985 | Johnson et al. | |
| 4,765,604 | A | 8/1988 | Trogan | |
| 4,778,441 | A | 10/1988 | Couturier | |
| 4,822,328 | A * | 4/1989 | Bertolini et al. | 493/425 |
| 4,917,665 | A | 4/1990 | Couturier | |
| 4,976,673 | A * | 12/1990 | Smith et al. | 493/194 |

(Continued)

FOREIGN PATENT DOCUMENTS

| | | |
|---|---|---|
| DE | 136 593 | 7/1979 |

(Continued)

*Primary Examiner*—Rinaldi I. Rada
*Assistant Examiner*—John Paradiso
(74) *Attorney, Agent, or Firm*—Boyle Fredrickson, S.C.

(57) ABSTRACT

An interfolding machine includes a first folding roll with a series of the gripper assemblies and a series of tucker assemblies uniformly and alternately spaced to interact with a series of gripper and tucker assemblies of an adjacent second folding roll. The series of alternately spaced gripper and tucker assemblies interact to grip, carry, and release a sheet of material in a manner so as to generate an interfolded stack of sheets. Each tucker assembly includes an outwardly biased tucker element that is operable to self-center in a slot formed in the folding roll. The tucker assembly further includes a roller mounted by a pin to the tucker element such that the tucker element rolls along a surface defined by the slot. Another embodiment of the tucker assembly includes a pivot spring and bumper to self-center the tucker element in the slot.

14 Claims, 14 Drawing Sheets

U.S. PATENT DOCUMENTS 5,088,707 A 2/1992 Stemmler
5,147,273 A 9/1992 Rottmann et al.
5,522,586 A 6/1996 Bennett et al.
5,609,557 A * 3/1997 Te ..... 493/344
5,772,571 A 6/1998 Marcle-Geller et al.
6,383,124 B1 5/2002 St. German et al.
6,916,281 B2 * 7/2005 Trovinger ..... 493/449
2003/0125180 A1 7/2003 Sosalla

FOREIGN PATENT DOCUMENTS

EP 0 322 186 6/1989

* cited by examiner

FIG. 6
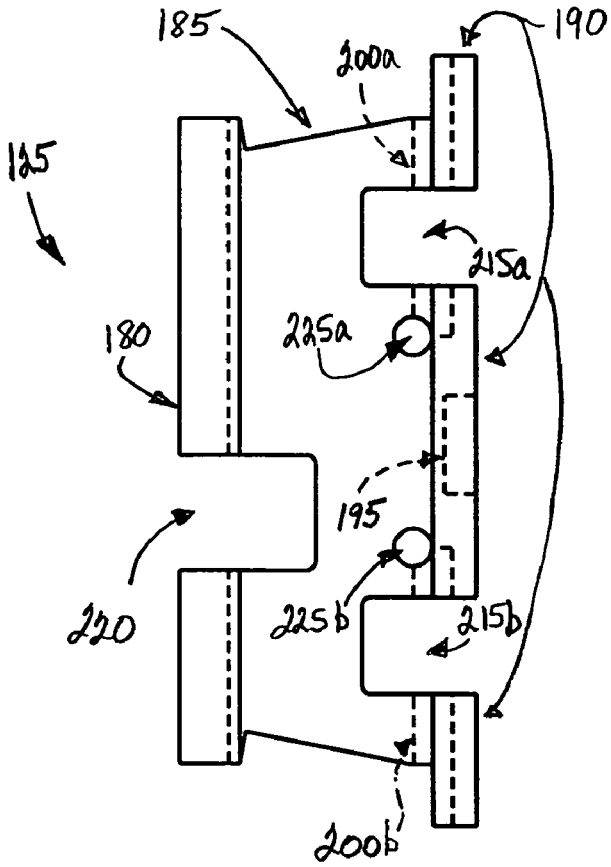
FIG. 7
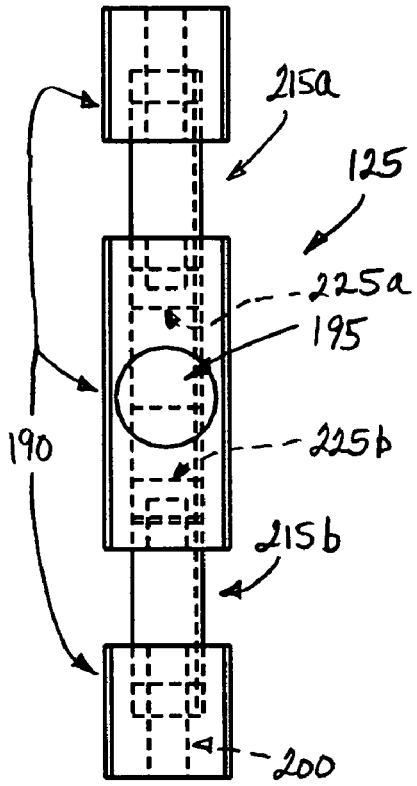
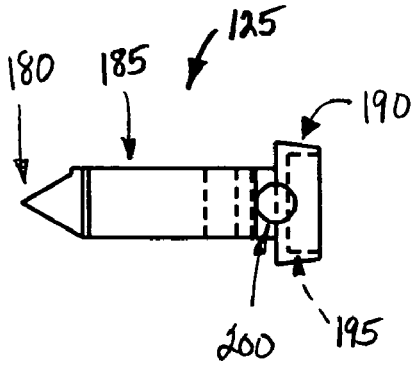
FIG. 8

FIG. 17
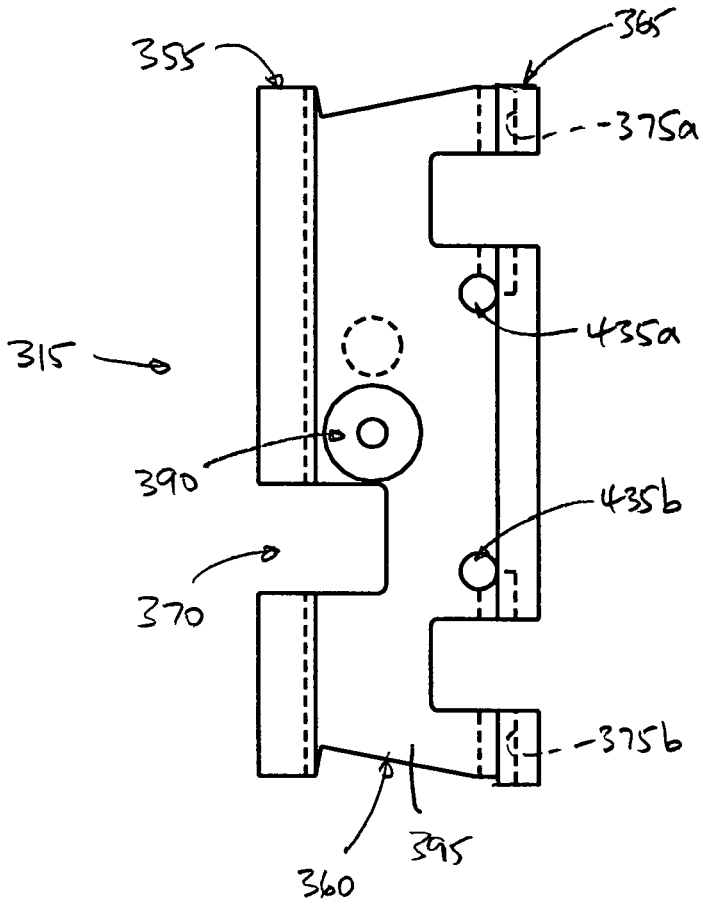
FIG. 18
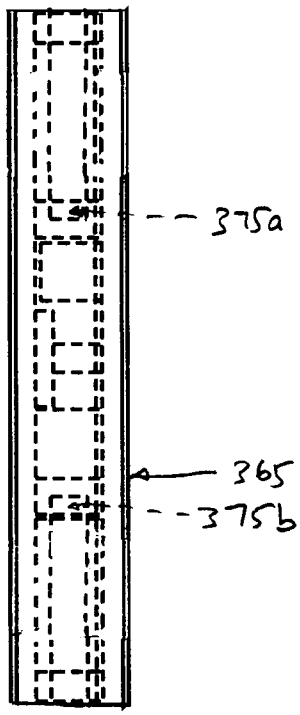
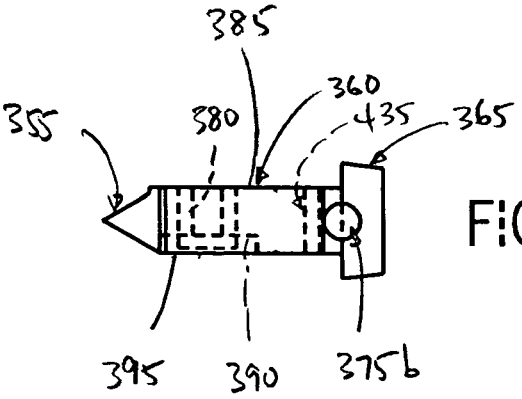
FIG. 19

SELF-CENTERING TUCKER ASSEMBLY FOR A FOLDING ROLL

RELATED APPLICATIONS

This application claims the benefit under 35 U.S.C. §119 (e) of U.S. Provisional Application Ser. No. 60/507,403, filed Sep. 30, 2003, and U.S. Provisional Application Ser. No. 60/507,405, filed Sep. 30, 2003, both of which are hereby incorporated herein by reference in their entirety.

FIELD OF THE INVENTION

This invention generally relates to a folding machine for folding sheets of material, and more specifically, to a folding machine that includes a self-centering tucker assembly configured to interact with an adjacent gripper assembly to create an interfolded stack of sheets.

BACKGROUND OF THE INVENTION

Folding of sheets of material (e.g., paper, napkins, paper towels, tissue, etc.) is frequently performed using a pair of folding rolls that have interacting mechanical gripper and tucker assemblies. The gripper and tucker assemblies are uniformly spaced around a circumference of each respective folding roll to interact with one another so as to interfold the sheets of material. The tucker assemblies on one roll interact with the gripper assemblies of the adjacent roll, and vice versa, to alternately grip and tuck successive sheets of material fed between the rolls. As the rolls rotate, the gripper assemblies carry and release the folded sheets of material to create a zigzagged interfolded stack of sheets.

Typically, each tucker assembly includes a rigid structure, referred to as a tucker, that protrudes from a slot or cavity in the outer surface of its the folding roll, and each gripper assembly is contained within a recess or slot in the folding roll. The tucker terminates in a point that extends outwardly of the outer surface of the folding roll, and is rigidly fixed in the slot or cavity in the folding roll to interface with a gripper assembly on the adjacent folding roll. As both the first and second folding rolls rotate, the tuckers that protrude from the outer surface of the first folding roll engage the gripper assemblies of the adjacent second folding roll, and vice versa. The sheets are fed between the first and second folding rolls, such that engagement of the tuckers and grippers of the folding rolls functions to fold the sheets during advancement of the sheets between the folding rolls. However, the protruding tucker typically rotates at a surface speed greater than the recessed gripper assembly in the adjacent roll, which can cause a snapped release of the tucker that interrupts and bounces the gripper assembly. The bounce can cause the gripper assembly to release the sheet of material and interrupt the output of the interfolding machine. Also, in the event the timing between the grippers and tuckers becomes disrupted, the interfolding machine can jam and the tucker can cause damage to the gripper and to the surface of the folding roll.

There is thus a need for a tucker assembly for a folding roll of an interfolder that can accommodate the difference in surface speed between the points of the tuckers and the grippers. There is also a need for a tucker that is capable of accommodating variations in the location of engagement of the tucker with the gripper, to prevent jamming that can occur when the timing between the rolls is disrupted.

SUMMARY OF THE INVENTION

In accordance with the present invention, there is provided a tucker assembly that includes a tucker element operable to pivot within a slot or cavity in the folding roll, and which includes a self-centering feature for providing alignment with the gripper assembly of the adjacent folding roll.

In accordance with one embodiment of the present invention, a tucker assembly is mounted on a first rotating roll and configured to interact with a gripper assembly of an adjacent rotating roll for gripping a sheet of material in a folding operation. The tucker assembly includes a cavity or slot located in the outer surface of the first rotating roll, within which the tucker element is located. The cavity or slot generally defines a slot surface. The tucker element is disposed in the cavity or slot, and a lateral passage is formed in the tucker element. The tucker assembly further includes a spring disposed in the slot, which is operable to bias the tucker element in a radially outward direction relative to the circumference of the first roll. The tucker assembly also includes a cap that is configured to retain the tucker element in the cavity or slot against the bias of the spring. A laterally extending pin is disposed in the transverse passage of the tucker element. The pin extends through a roller, which is configured to pivot or roll the tucker element along a mating roll surface defined by the cavity or slot. The tucker element is configured to retract against the bias of the spring, and the biasing force of the spring combined with the pivotable mounting of the tucker element functions to self-center the tucker element within the slot.

In a preferred embodiment, the cap includes an arcuate outer face, and an inner surface of the cap defines a slot configured to receive the laterally extending pin, which is biased by the spring against the cap. The tucker element includes a base portion opposite the pointed outer end defined by the tucker element, and the base portion includes a recess within which the outer end of the spring is received. At least a portion of the laterally extending pin extends in a generally axially outwardly from the base portion of the tucker element and is received between a slot in the base portion of the tucker element and the slot portion in the cap. The tucker element further includes a recess within which the roller is received. The tucker element can further include a second transverse passage to receive a second laterally extending pin, in general alignment with the first transverse passage and first laterally extending passage within which the first pin is engaged. A least an outer end portion of the second pin is engaged with an adjacent tucker element. The tucker element may also include a second recess to receive a second roller mounted on the second pin.

The invention also contemplates a folding machine that includes a first folding roll with a series of the gripper assemblies and a series of tucker assemblies uniformly and alternately spaced to interact with a series of gripper and tucker assemblies of an adjacent second folding roll. The series of alternately spaced gripper and tucker assemblies generally interact to grip, carry, and release sheets of material in a manner so as to generate a folded stack of sheets. Each of the tucker assemblies generally includes a tucker element disposed in a cavity or slot in the first folding roll, and the tucker element includes one or more transverse passages. A spring is disposed in the cavity or slot, and engages the tucker element to bias the tucker element in a radially outward direction relative to a circumference of the first folding roll. A cap is configured to retain the tucker element in the cavity or slot against the bias of the spring. One or more laterally extending pins extend into the one or more transverse passage of the tucker element. A roller arrangement, including one or more rollers, is mounted on the one or more pins so as to pivot or roll the tucker element along a mating surface defined by the cavity or slot. The tucker element is configured to retract against the bias of the spring as well as to pivot about the one or more pins in a self-centering manner in the cavity or slot.

In accordance with another embodiment of the invention, a folding roll assembly generally includes a roll having n outer surface, a cavity or slot disposed along the outer surface of the roll, and a tucker element disposed in the cavity or slot. The folding roll assembly includes a centering spring configured to bias the tucker element in a lateral direction normal to the radial outward direction of the roll, and a tucker cap configured to retain the tucker element in the slot. The tucker cap defines an arcuate outer surface that engages an arcuate inner surface defined by the roll. The tucker assembly further includes a pivot arrangement configured to allow pivoting movement of the tucker element in the cavity or slot. A bumper is mounted in the cavity or slot opposite the centering spring, and works in combination with the centering spring to self-center the tucker element in the cavity or slot.

In accordance with a further aspect of the invention, there is provided a method of interacting a tucker assembly of a first rotating folding roll with a gripper assembly mounted on an adjacent second rotating folding roll with a sheet of material disposed therebetween. The method generally includes the steps of providing a tucker element disposed in a slot defined by a first roll adjacent to a gripper assembly disposed in a slot defined by an adjacent second roll; rotating the first and second rolls such that the tucker element of the first roll interfaces with the gripper assembly of the second roll; biasing the tucker element in a radially outward direction; restraining the tucker element in the slot with a laterally extending pin extending outwardly from the tucker element and biased against a cap mounted on the first roll; engaging the tucker element with the sheet of material to move the sheet into engagement with the gripper assembly; pivoting the tucker element about the laterally extending pin extending from the tucker element; and aligning the tucker element in a generally centered position in the slot about the pin.

In accordance with yet another aspect of the invention, there is provided a method of folding a sheet of material. The method generally includes the steps of providing a first rotating roll having a tucker assembly with a tucker element, and a second rotating roll having a gripper assembly with a blade and an anvil disposed to interface with the tucker assembly of the first rotating roll; engaging the tucker element with the sheet of material against the anvil of the gripper assembly; moving the blade of the gripper assembly against the tucker element to move the sheet of material against the anvil; pivoting the tucker element against the bias of a centering spring disposed in the slot against a bumper; releasing the tucker element from engagement with the sheet of material; and subsequently aligning the tucker element in a generally centered orientation within the slot.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout. In the drawings:

FIG. 6 is a detailed side elevation view of a tucker element incorporated in the tucker assembly shown in FIG. 4.

FIG. 7 is a detailed bottom elevation of the tucker element shown in FIG. 4.

FIG. 8 is a detailed end elevation view of the tucker element shown in FIG. 4.

FIG. 17 is a detailed side elevation view of a tucker element incorporated in the tucker assembly as shown in FIGS. 15 and 16.

FIG. 18 is a detailed bottom plan view of the tucker element shown in FIG. 17.

FIG. 19 is a detailed end elevation view of the tucker element shown in FIG. 17.

DETAILED DESCRIPTION OF THE INVENTION

1. Folding Machine

Figure 1:
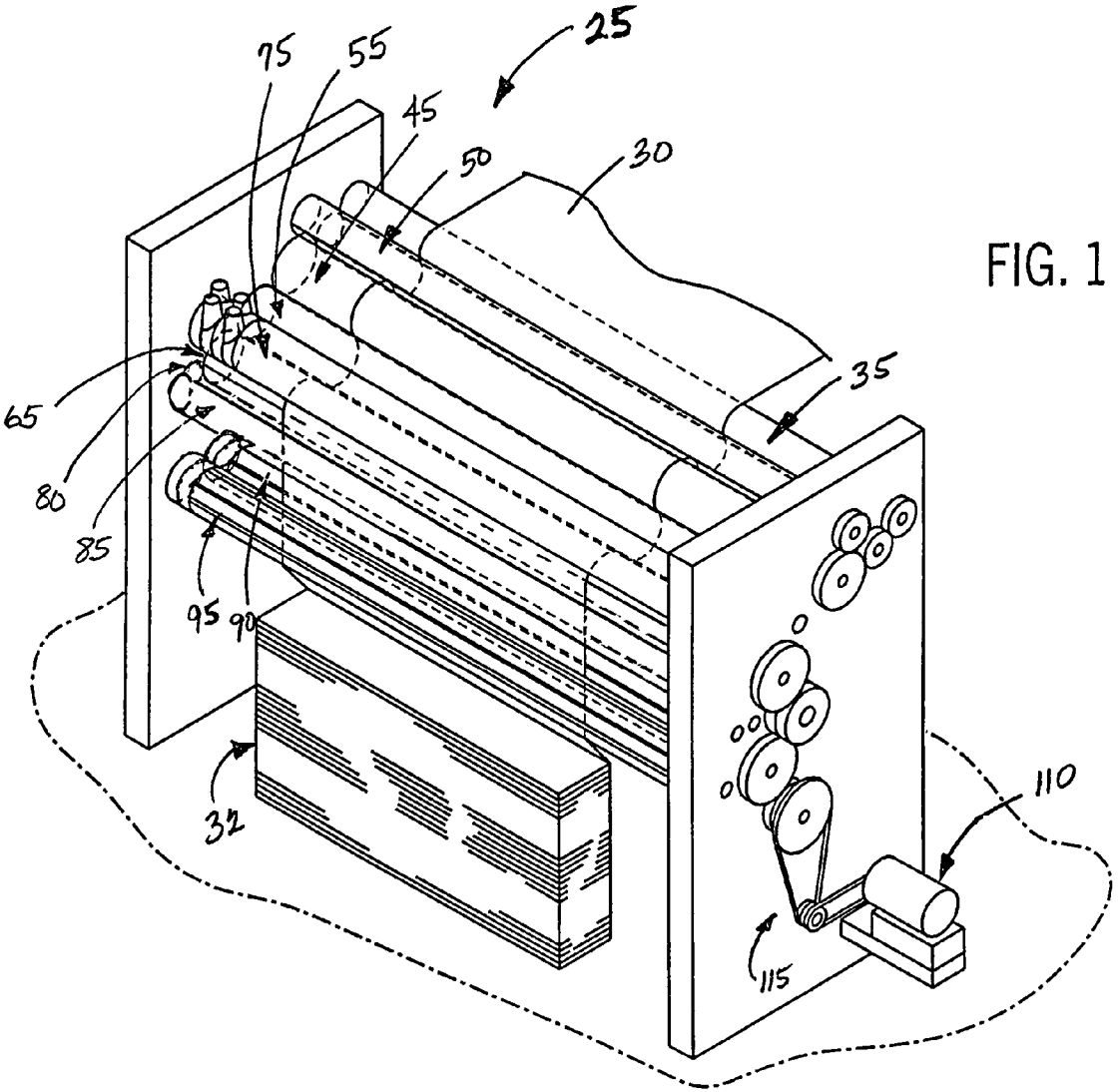
FIG. 1 is an isometric view of an interfolding machine employing a folding roll incorporating a tucker assembly in accordance with the present invention.
Figure 2:
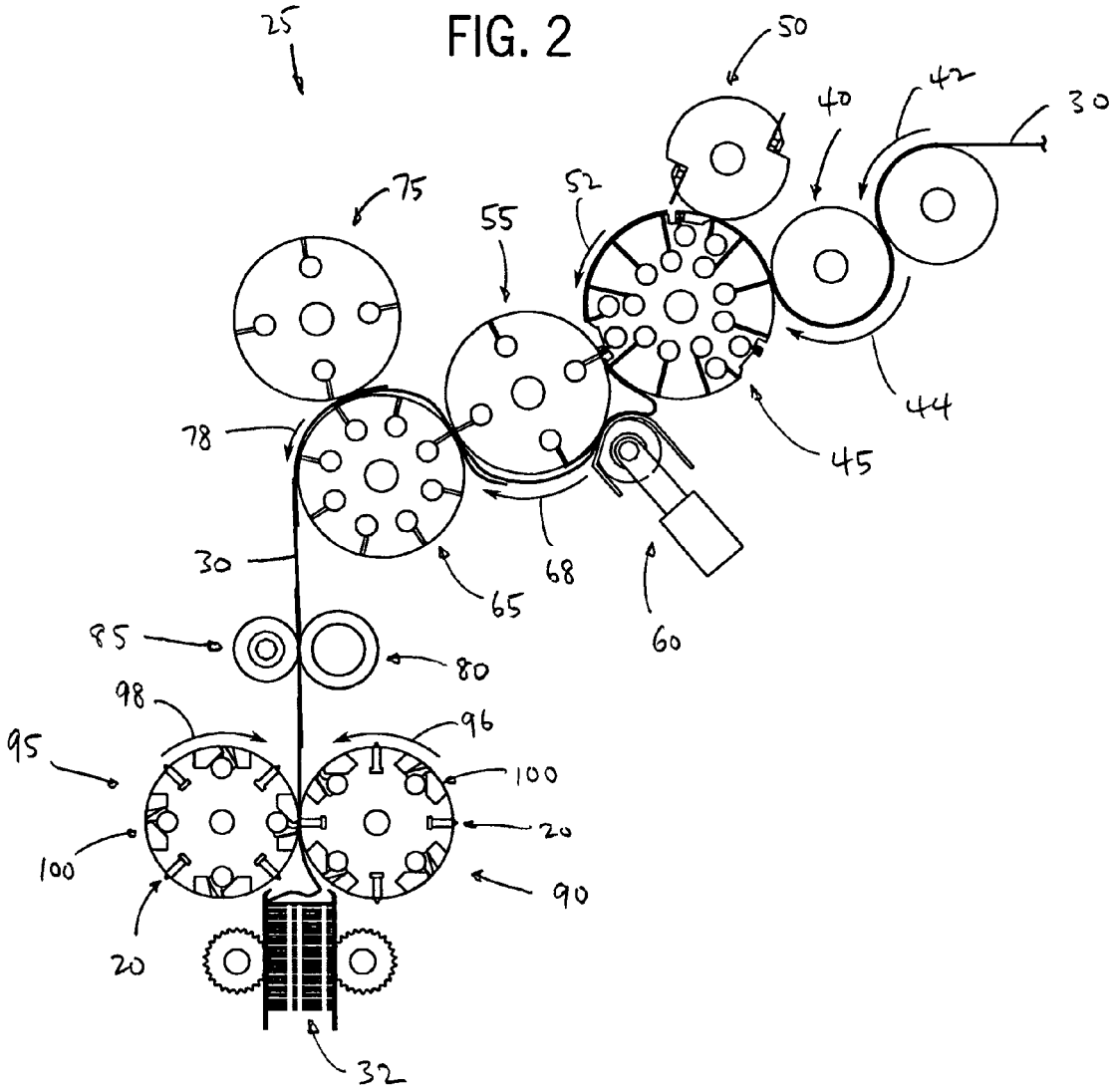
FIG. 2 is a schematic side elevation view of the interfolding machine as shown in FIG. 1.

Referring to FIGS. 1 and 2, an interfolding machine 25 is operable to convert a web of material 30 into a stack of interfolded sheets of material shown at 32. Interfolding machine 25 includes folding rolls incorporating the tucker assembly of the present invention, and generally includes a first pull roll 35 and a second pull roll 40 that receive the web of material 30 along a path (illustrated by an arrow 42 in FIG. 2) from a supply roll (not shown) into the interfolding machine 20. The first and second pull rolls 35 and 40 define a nip through which the web of material 30 passes, and function to unwind the web of material 30 and feed the web of material 30 in a path (illustrated by an arrow 44 in FIG. 2) toward a nip defined between second pull roll 40 and a bed roll 45. The web of material 30 is then advanced by bed roll 45 toward a knife roll 50. In a manner as is known, the knife roll 50 cuts the web of material 30 into sheets, each of which has a predetermined length, and the bed roll 45 carries the sheets of material along a path (illustrated by arrow 52 in FIG. 2) toward and through a nip defined between bed roll 45 and a retard roll 55, which rotates at a slower speed of rotation than the bed roll 45. In a manner as explained in copending application Ser. No. 10/953,175 filed Sep. 29, 2004, the retard roll 55 cooperates with a nip roller assembly 60 (FIG. 2) to form an overlap between the consecutive sheets of material. The retard roll 55 carries the overlapped sheets of material along a path (illustrated by arrow 68 in FIG. 2) to a lap roll 65.

The lap roll 65 works in combination with a count roll 75 to eliminate the overlap between adjacent sheets of material at a predetermined sheet count, so as to create a separation in the stack 32 of interfolded sheets discharged from the interfolding machine 25. The lap roll 65 carries the overlapped sheets of sheet 30 along a path (illustrated by arrow 78 in FIG. 2) toward a nip defined between a first assist roll 80 and an adjacent second assist roll 85. The first and second assist rolls 80 and 85 feed the sheets of the material to a nip defined between a first folding roll 90 and a second folding roll 95.

Referring to FIG. 2, the first and second folding rolls 90 and 95 generally rotate in opposite directions (illustrated by arrows 96 and 98, respectively, in FIG. 2) to receive the overlapped sheets of material 30 therebetween. The periphery of the first folding roll 90 generally includes a series of the tucker assemblies 20 in accordance with the invention, and a series of gripper assemblies 100 uniformly and alternately spaced to interact with a series of tucker assemblies 20 and gripper assemblies 100 of the adjacent second folding roll 95. The series of alternately spaced tucker assemblies 20 and gripper assemblies 100 of the first and second folding rolls 90 and 95 interact to grip, carry, and release the sheets of material in a desired manner so as to form the desired interfolded relationship in the sheets of material and to form stack 32 of interfolded sheets. The folding rolls 90 and 95 may be driven by a drive system 110 having a drive belt assembly 115 (FIG. 1).

The stack 32 of interfolded sheets is discharged from between the first and second folding rolls 90 and 95 in a generally vertically-aligned fashion. The stack 32 of interfolded sheets may be supplied to a discharge and transfer system (not shown), which guides and conveys the stack 32 from the generally vertically-aligned orientation at the discharge of the interfolding machine 25 to a generally horizontally-aligned movement. One embodiment of a suitable discharge and transfer system is described in U.S. Pat. No. 6,712,746 entitled "Discharge and Transfer System for Interfolded Sheets," filed May 5, 2000, the disclosure of which is hereby incorporated herein by reference in its entirety. Another representative discharge and transfer system is illustrated in copending application Ser No. 10/610,458, the disclosure of which is also hereby incorporated herein by reference in its entirety.

2. Tucker Assembly

As illustrated in FIG. 2, each of the gripper assemblies 20 is generally located at a distance from the next adjacent tucker assembly 100 along a circumference of each of the first and second folding rolls 90 and 95. The spacing between the gripper assemblies 100 and the tucker assemblies 20 determines the longitudinal dimension or length between the folds in the sheets of sheet 30 as measured in a direction of travel (illustrated by arrows 96 and 98) of the first and second folding rolls 90 and 95.

Figure 3:
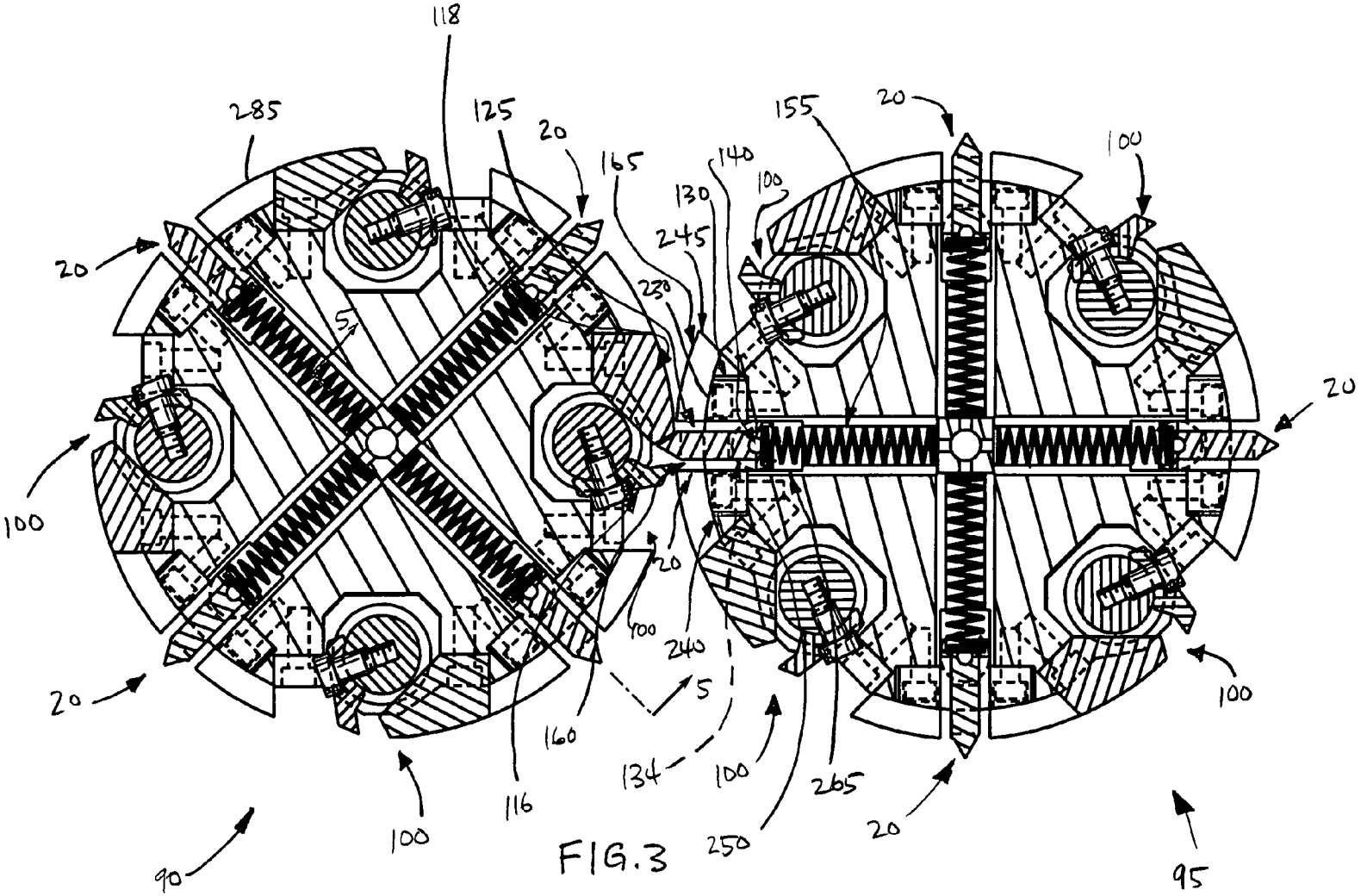
FIG. 3 is a detailed cross-sectional view of first and second folding rolls incorporated in the interfolding machine as shown in FIGS. 1 and 2, illustrating a first embodiment of a tucker assembly in accordance with the present invention.

FIGS. 3 illustrates a detailed cross-sectional view of folding rolls 90 and 95, showing one of the series of tucker assemblies 20 in accordance with the present invention, and which is mounted to folding roll 95, interacting with one of the series of gripper assemblies 100 of folding roll 90. It is understood that the other alternating series of gripper assemblies 100 and tucker assemblies 20 of both the first and second folding rolls 90 and 95 (as schematically illustrated in FIG. 2) are constructed similarly and interact in a similar manner. As illustrated in FIG. 3, the tucker assembly 20 generally extends in a radial outward direction from the outer circumference of the folding roll 95 to engage the gripper assembly 100 that is generally positioned in a recessed location on the folding roll 90. Representatively, gripper assembly 100 may be constructed as shown and described in copending application Ser. No. 10/953,379, the disclosure of which is hereby incorporated by reference. As the sheet of material 30 moves between the first and second folding rolls 90 and 95, the tucker assembly 20 is configured to tuck the sheet 30 between a blade 116 and an anvil 118 of the gripper assembly 100, when the gripper assembly 100 is in an open position. The blade 116 of the gripper assembly 100 subsequently rotates in a timed manner to grip the tucked sheet 30 against anvil 118 as the tucker assembly 20 is moved out of engagement with the sheet 30. In the closed position, the gripper assembly 100 carries and then releases the sheet 30 so as to create the folds in the sheets 30 that are formed in interfolded stack 32.

Figure 4:
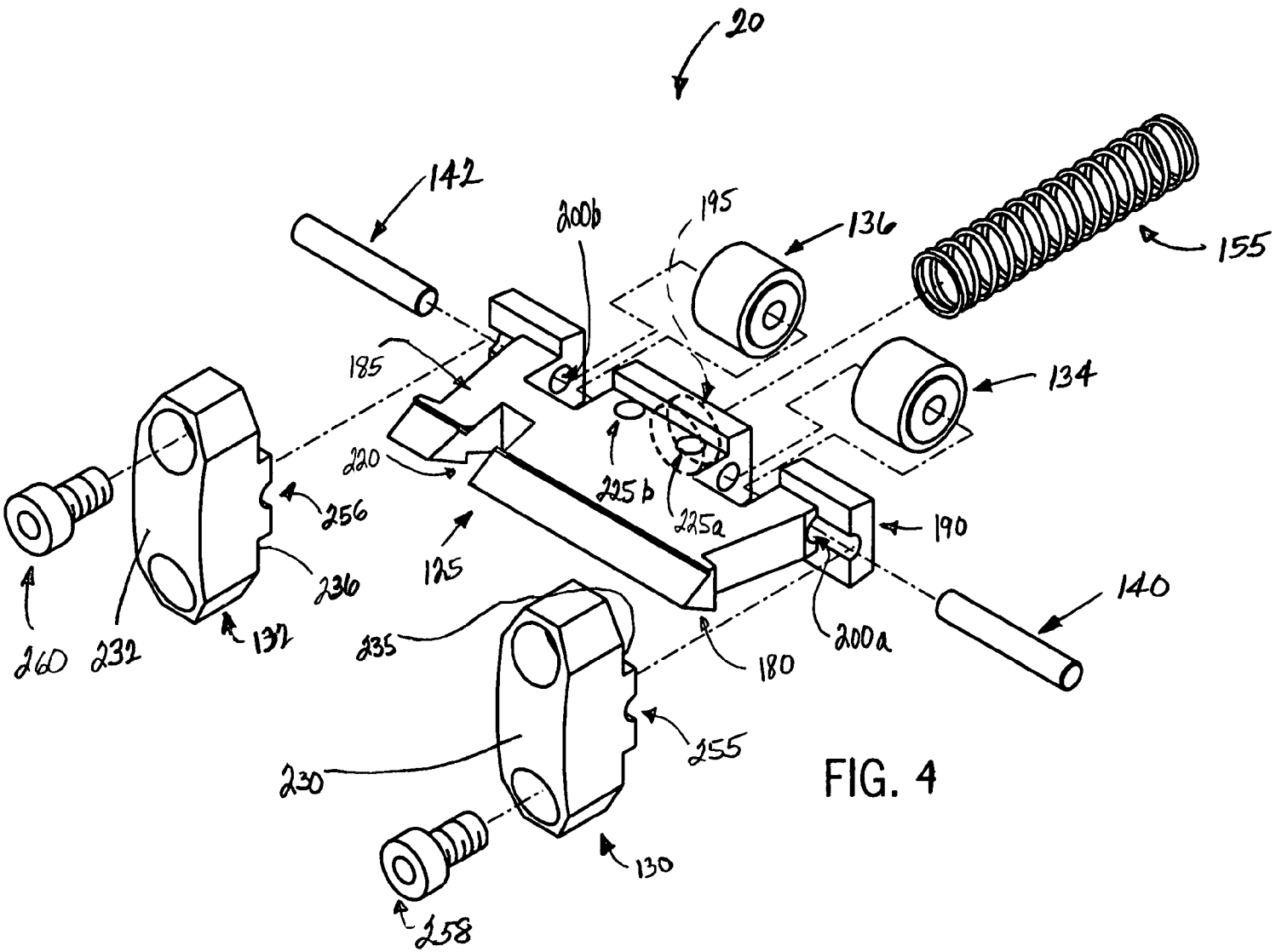
FIG. 4 is an exploded isometric view of the tucker assembly as shown in FIG. 3.
Figure 5:
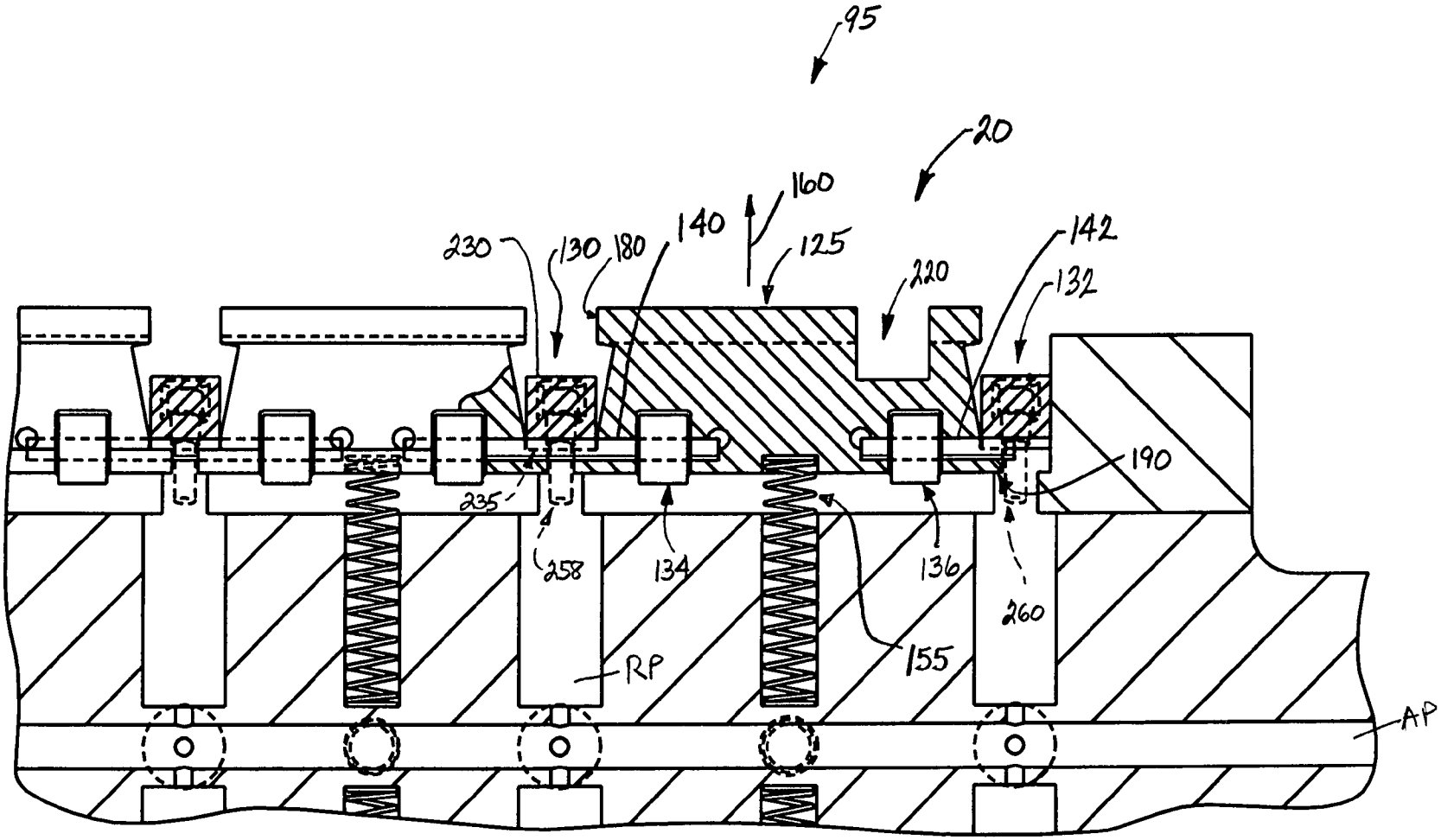
FIG. 5 is a partial cross-sectional view of the tucker assembly along line 5-5 of FIG. 3.

FIGS. 3-5 show one embodiment of the tucker assembly 20 in accordance with the present invention. In the illustrated embodiment, tucker assembly 20 has a sectioned tucker element 125, a first and a second tucker cap 130 and 132, respectively, a first and a second roller 134 and 136, respectively, a first and a second pin 140 and 142, respectively, and a spring 155 disposed in a cavity or slot 160 in the folding roll 95. It is understood that others in the series of tucker assemblies 20 of the first and second folding rolls 90 and 95 are constructed in similar manner.

The spring 155 generally biases the tucker element 125 in a radially outward direction (illustrated by arrow 160) with respect to the outer periphery or circumference 165 of the folding roll 95.

FIGS. 6-8 show the tucker element 125 of FIGS. 3-5 in detail. The tucker element 125 includes a pointed end 180, a midsection 185, and a base portion 190. The pointed end 180 is configured to engage the gripper assembly 100 of the adjacent folding roll 90 (FIG. 3). The base portion 190 of the tucker element 125 includes a recess or opening 195 to receive the outer end of the spring 155. First and second transverse pin openings or passages 200*a* and 200*b*, respectively, extend along an axial length of the tucker element 125 and are configured to receive the pins 140 and 142, respectively. A pair of inner recesses 215*a* and 215*b* extend outwardly from the inner surface of the base portion 190 of the tucker element 125, and are configured to receive the rollers 134 and 136, respectively. The number of recesses 215*a* and 215*b* and respective rollers 134 and 136 can vary. An outer recess 220 extends inwardly from the pointed end 180. Another pair of openings 225*a* and 225*b* pass through the midsection 185. The openings 225*a* and 225*b* receive fasteners (not shown) to hold the pins 140 and 142 in position on the tucker element 125.

Referring back to FIGS. 4 and 5, the tucker caps 130 and 132 are generally disposed between adjacent tucker elements 125 (See FIG. 3) in a manner so as to restrain the pins 140 and 142 and the tucker element 125 against the bias of the spring 155. As illustrated in FIG. 4, the tucker caps 130 and 132 generally include respective outer faces 230 and 232 and respective inner faces 235 and 236. The outer faces 230 and 232 are generally arcuate-shaped, and match an arcuate shape of an inner surface 240 defined by an outer wall section 245 of the folding roll 95 (See FIG. 3). The inner faces 235 and 236 are generally configured to interface with the base portion 190 of the tucker element 125 and with an inner surface 250 of the folding roll 95 (See FIG. 3). The inner faces 235 and 236 further include slot portions 255 and 256, respectively, which retain at least a portion of the pins 140 and 142, respectively, against base portion 190 of the tucker element 125. Fasteners 258 and 260 in combination with the caps 130 and 132, respectively, mount the tucker element 125 to the folding roll 95 against the bias of the spring 155.

Still referring to FIGS. 4 and 5, the pins 140 and 142 are engaged within the openings or passages 200*a* and 200*b*, respectively, in the tucker element 125. The pins 140 and 142 extend into aligned axial passages in rollers 134, 136, respectively, and define inner portions that are received within aligned passages in rollers 134, 136, respectively, to support the tucker 125 on the rollers 134 and 136, respectively. The pins 140 and 142 extend axially outwardly from the tucker element 125, and are received between the slot portions 255 and 256 of the caps 130 and 132 and outwardly facing troughs formed in the base portion 190 of the tucker element 125. The pins 140 and 142 and mounted rollers 134 and 136, respectively, provide rotational location and guidance for inward and outward movement of the tucker element 125 along facing walls or surfaces 265 defining the cavity or slot 160 (FIG. 3).

Folding roll 95 also defines a central axial passage AP which is supplied with pressurized air from a suitable pressurized air source, and which communicates with radial passages RP formed in folding roll 95that supply pressurized air to cavity or slot 160 inwardly of tucker element 120 and caps 130, 132. This feature functions to expel air under pressure around the components of tucker assembly 20.

Figure 9:
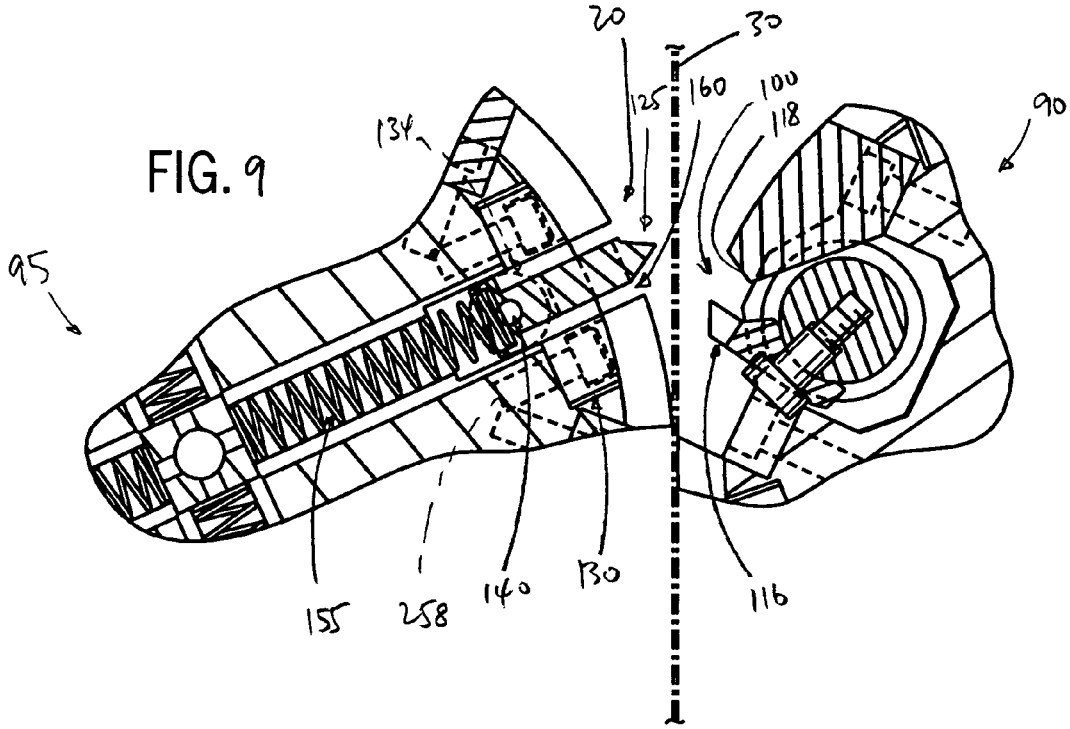
FIG. 9 is a an enlarged partial cross-sectional view of the tucker assembly of a first folding roll and the gripper assembly of an adjacent folding roll of the interfolding machine shown in FIG. 2, showing the tucker assembly approaching the gripper assembly during advancement of a sheet of material therebetween.
Figure 10:
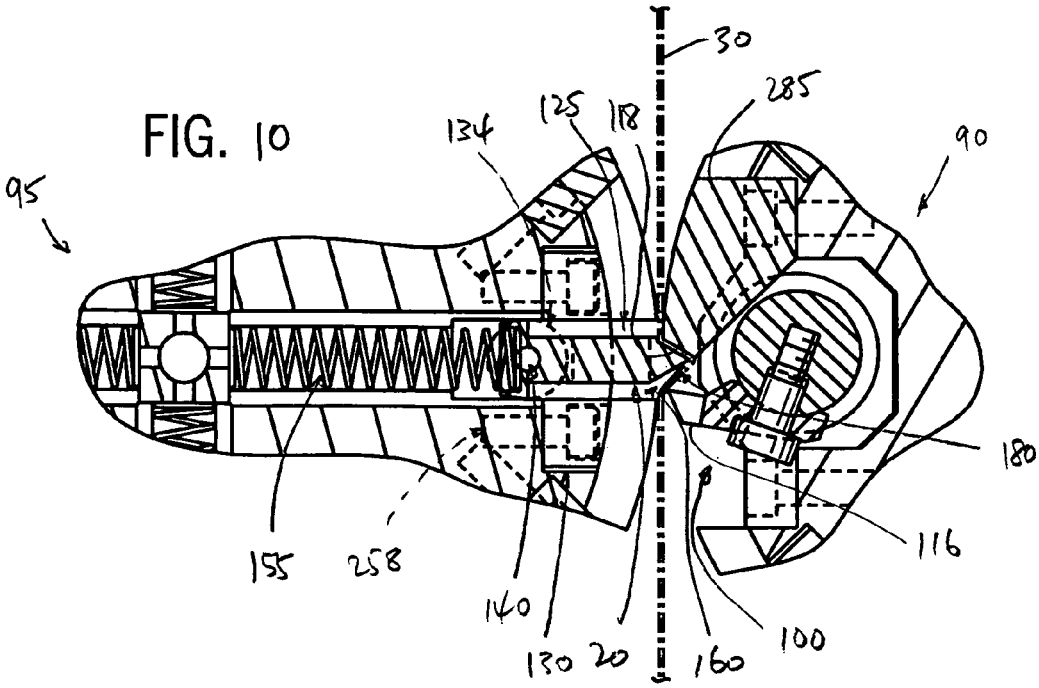
FIG. 10 is a view similar to FIG. 9, showing the tucker assembly tucking the sheet of material into the gripper assembly.
Figure 11:
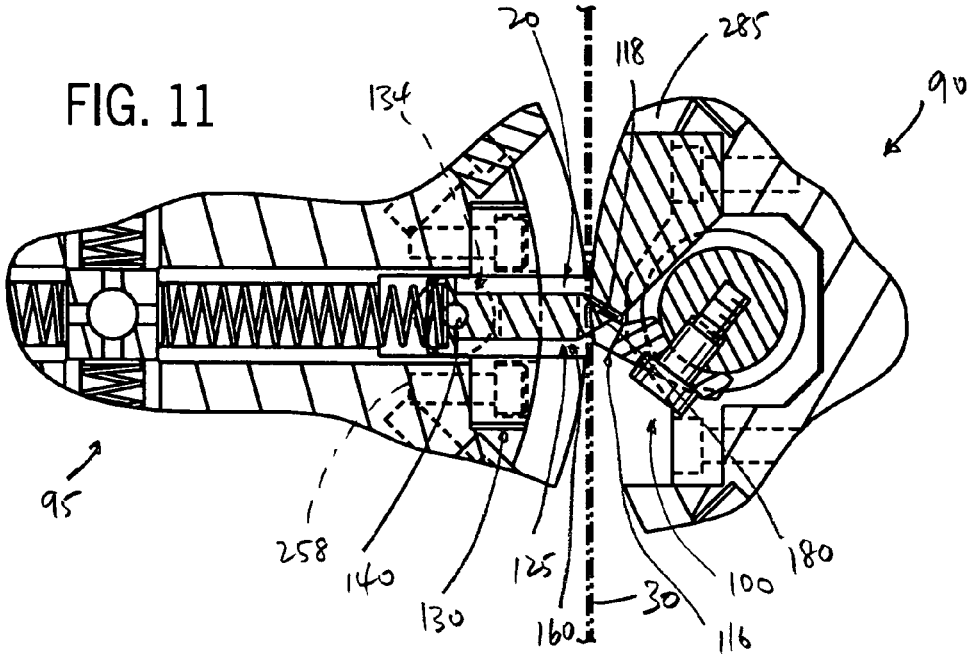
FIG. 11 is a view similar to FIGS. 9 and 10, showing, the gripper assembly gripping the sheet of material.
Figure 12:
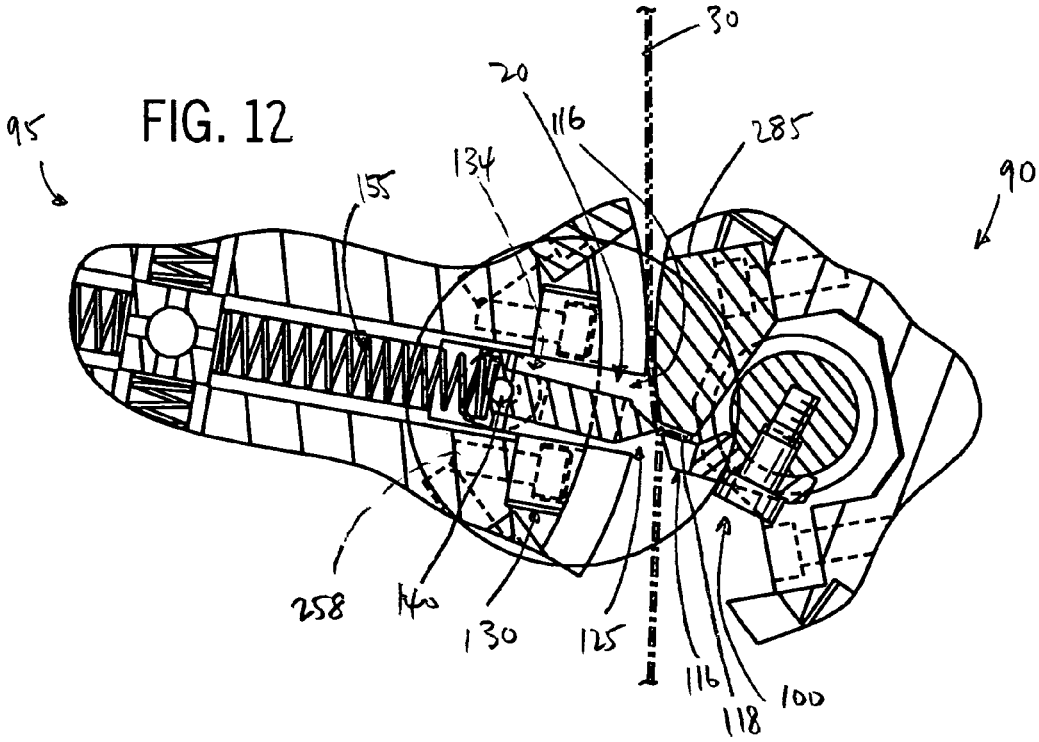
FIG. 12 is a view similar to FIGS. 9-11, showing pivoting movement of the tucker element of the tucker assembly to release the sheet of material.
Figure 13:
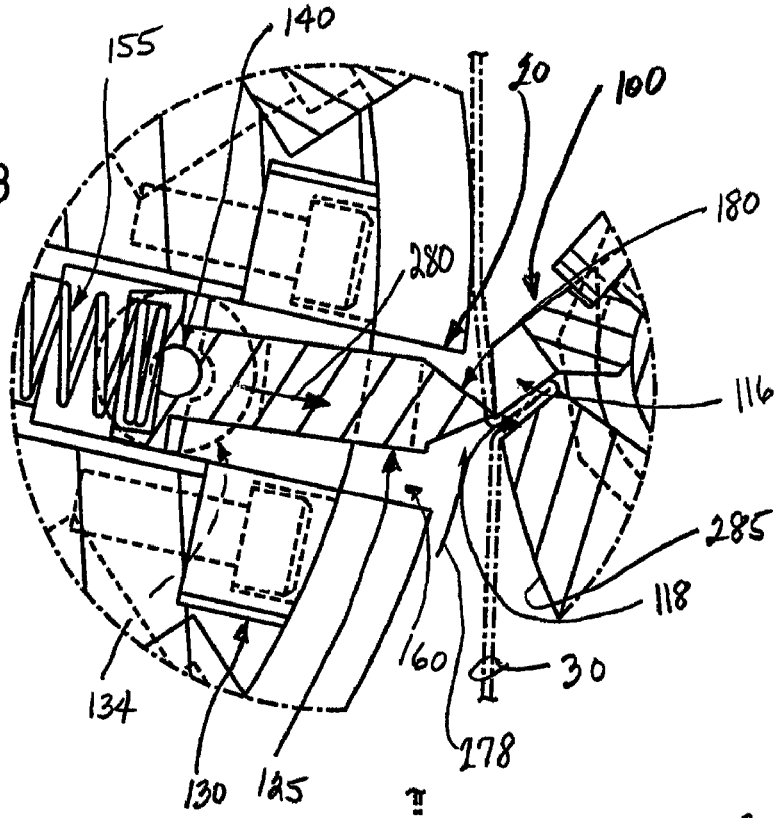
FIG. 13 is an enlarged detailed cross-sectional view of the tucker element of the tucker assembly as shown in FIG. 12.
Figure 14:
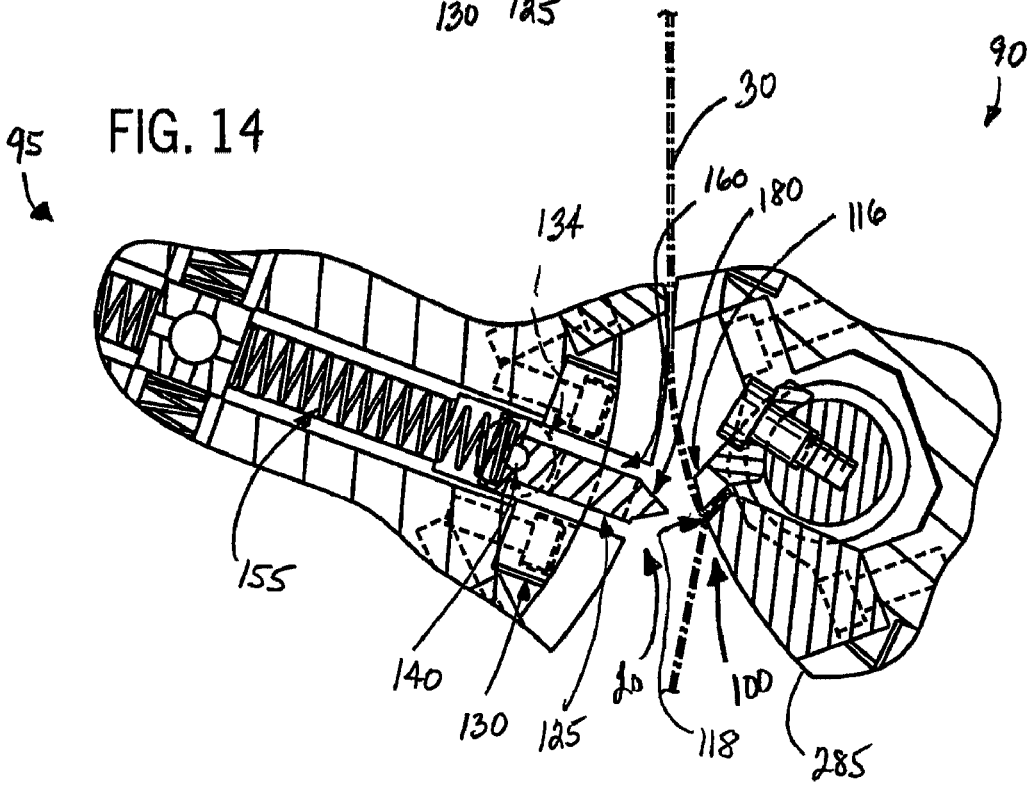
FIG. 14 is a view similar to FIGS. 9-12, showing the tucker assembly disengaged from the gripper assembly.

FIGS. 9-14 generally illustrate the sequence of operation of the tucker assembly 20. In FIG. 9, the tucker assembly 20 is generally held in a radially aligned position in the slot 160 by the pins 140 and 142 in combination with the caps 130 and 132 (FIGS. 4 and 5) by application of an outward biasing force applied by the spring 155. As roll 95 rotates in a clockwise direction from the position of FIG. 9 toward the position of FIG. 10, pointed end 180 of tucker element 125 contacts sheet 30 so as to create a fold or crease in sheet 30. Tucker element 125 then interacts with the gripper assembly 100 of the adjacent roller 90 as illustrated in FIG. 10, so as to position the fold or crease in sheet 30 against the anvil of the gripper assembly 100 while the blade 116 of gripper assembly 100 is maintained in the open position. During such movement of tucker assembly 20, the spring 155 forces the tucker element 125 outwardly, and maintains tucker element 125 in a radially aligned position. Blade 116 of gripper assembly 100 is then moved to the closed position as shown in FIG. 11, so that blade 116 engages the sheet 30 within the recess 220 defined by tucker element 125, to clamp the fold in sheet 30 against the anvil 118. Continued rotation of folding rolls 90 and 95, as shown in FIG. 12, results in pivoting movement of tucker element 125 about the pins 140 and 142 (FIGS. 4 and 5) while engaged by the gripper assembly 100, so that tucker element 125 is positioned at an angle relative to the radial axis of cavity or slot 160. As the folding rolls 90 and 95 rotate, the tucker element 125 is free to move against the anvil 118 as dictated by the spring-loaded blade 116 of the gripper assembly 100. FIGS. 12 and 13 illustrate that, as the adjacent folding rolls 90 and 95 continue to rotate, the tucker element 125 pivots (illustrated by arrow 278) and extends (illustrated by arrow 280) upon disengagement with gripper assembly 100. As the tucker element 125 pivots and extends in this manner, the blade 116 of the gripper assembly 100 engages against the sheet 30 and the anvil 118, limiting bounce as the gripper assembly 100 carries the sheet 30. Upon continued rotation of folding rolls 90 and 95, as shown in FIG. 14, the bias of the spring 155 and the interaction of the base portion 190 and the pins 140 and 142 against the caps 130 and 132 functions in combination to re-center the tucker element 125 in a generally radially aligned position in the slot 160.

In the event timing of the rolls 90 and 95 is off or the tucker encounters an obstruction such that the tucker element 125 comes into contact with an outer surface 285 of the adjacent roll 90 or with the anvil of gripper assembly 100, the tucker element 125 is operable to retract against the bias of the spring 155 in a radially inward direction (illustrated by arrow 280 in FIG. 13) along the slot 160. Upon retracting in the slot 160, the pins 140 and 142 are moved inwardly out of contact with the cap slot portions 255, 256. The rollers 134 and 136 roll inwardly along the surfaces 265 of slot 160, against the outward biasing force of spring 155, until the pointed end 180 of tucker element 125 is moved out of contact with the outer surface 285 or the anvil of gripper assembly 100. Rollers 134, 136 function to maintain base 190 of tucker element 125 and pins 140 and 142 in a centered position in the slot 160. Thereafter, spring 155 functions to move tucker element 125 outwardly to seat pins 140 and 142 in engagement with cap slot portions 255, 256, respectively. As explained previously, spring 155 then operates to return tucker element 125 to a radially aligned position within cavity or slot 160. This feature enables tucker assembly to accommodate slight misalignment between tucker assembly 20 and gripper assembly 100, and reduces the potential costly and undesirable jams that may otherwise occur during operation of the interfolding machine 25.

Figure 15:
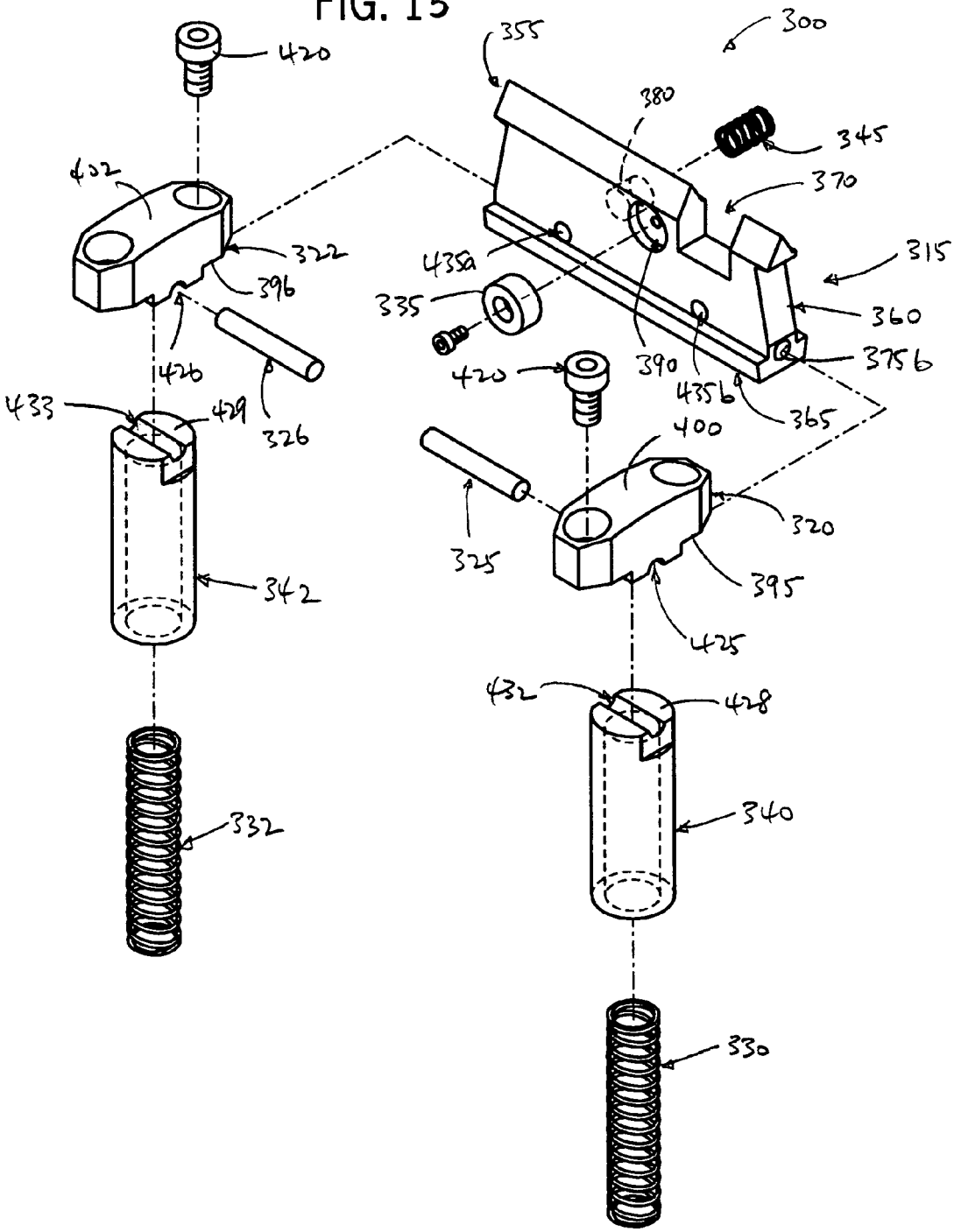
FIG. 15 is an exploded isometric view of a second embodiment of a tucker assembly incorporated in the folding rolls of an interfolding machine as shown in FIGS. 1 and 2.
Figure 16:
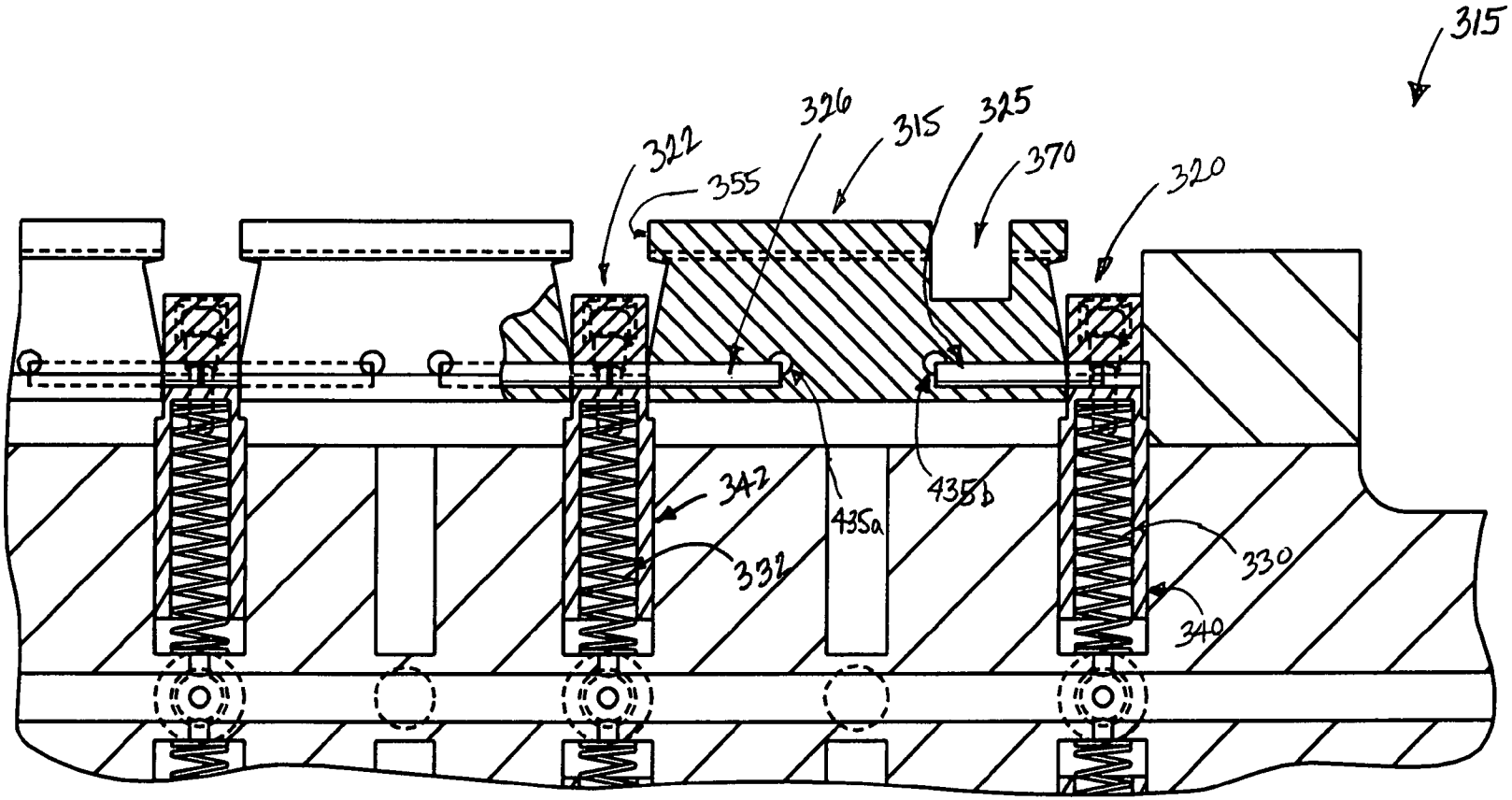
FIG. 16 is an enlarged partial section view similar to FIG. 5, showing the second embodiment of the tucker assembly as illustrated in FIG. 15.

FIGS. 15 and 16 show another embodiment of a tucker assembly in accordance with the present invention. In this embodiment, the tucker assembly is shown at 300, and is mounted on adjacent folding rolls 305 and 310 that have a similar construction and operation as folding rolls 90 and 95 as shown and described previously, including alternately spaced tucker assemblies 300 and gripper assemblies 312 that are constructed similarly to gripper assemblies 100 described above.

Figure 20:
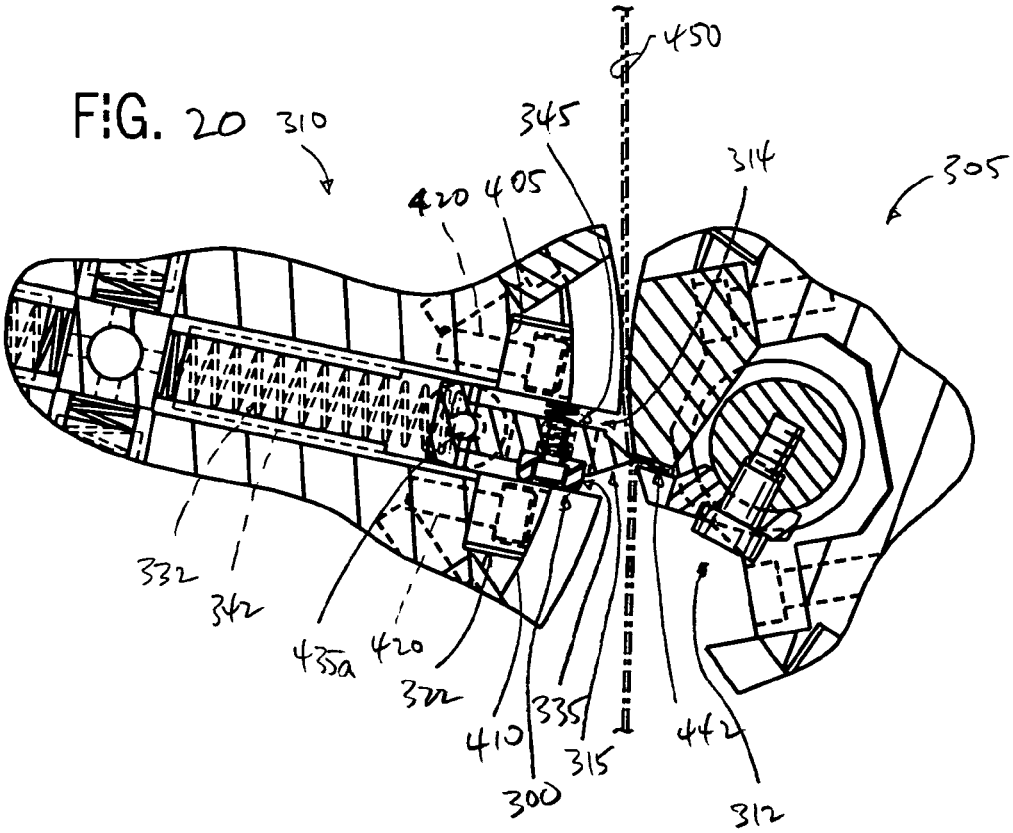
FIG. 20 is a detailed cross-sectional view similar to FIGS. 9-12, showing the tucker assembly of FIG. 15 interacting with the gripper assembly of the adjacent folding roll, in a position in which the tucker assembly releases the sheet of material.
Figure 21:
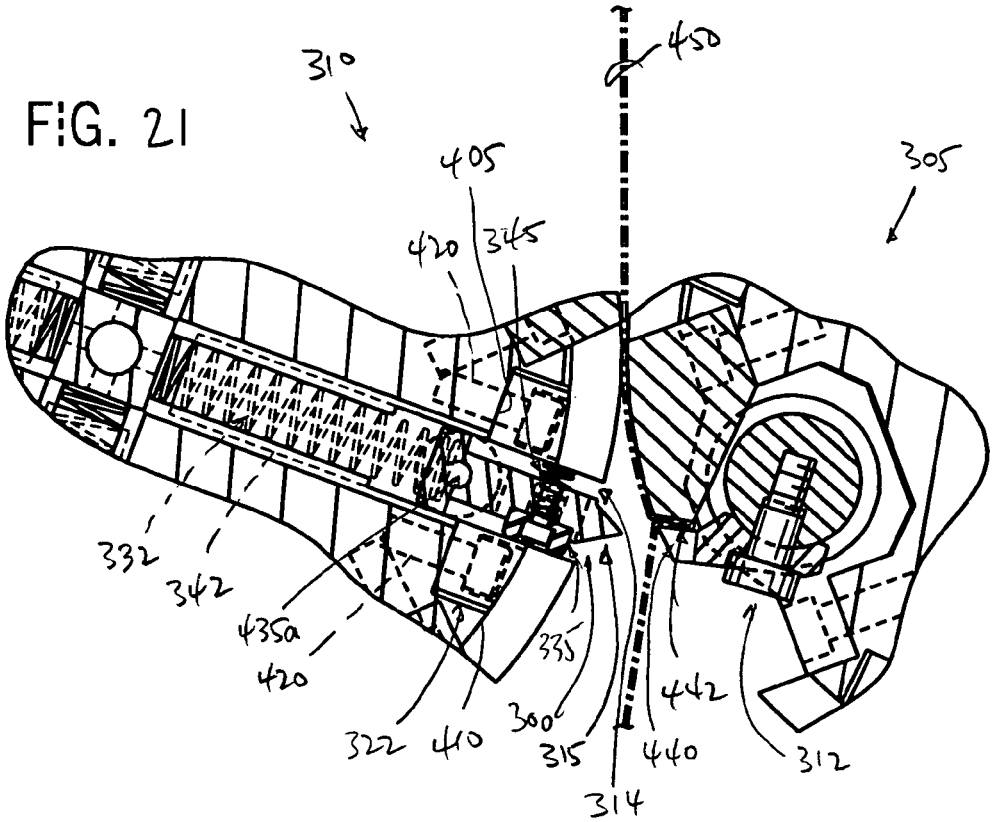
FIG. 21 is a detailed cross-sectional view similar to FIG. 20, showing the tucker assembly of FIG. 15 in a position in which the tucker assembly is disengaged from the gripper assembly.
Figure 22:
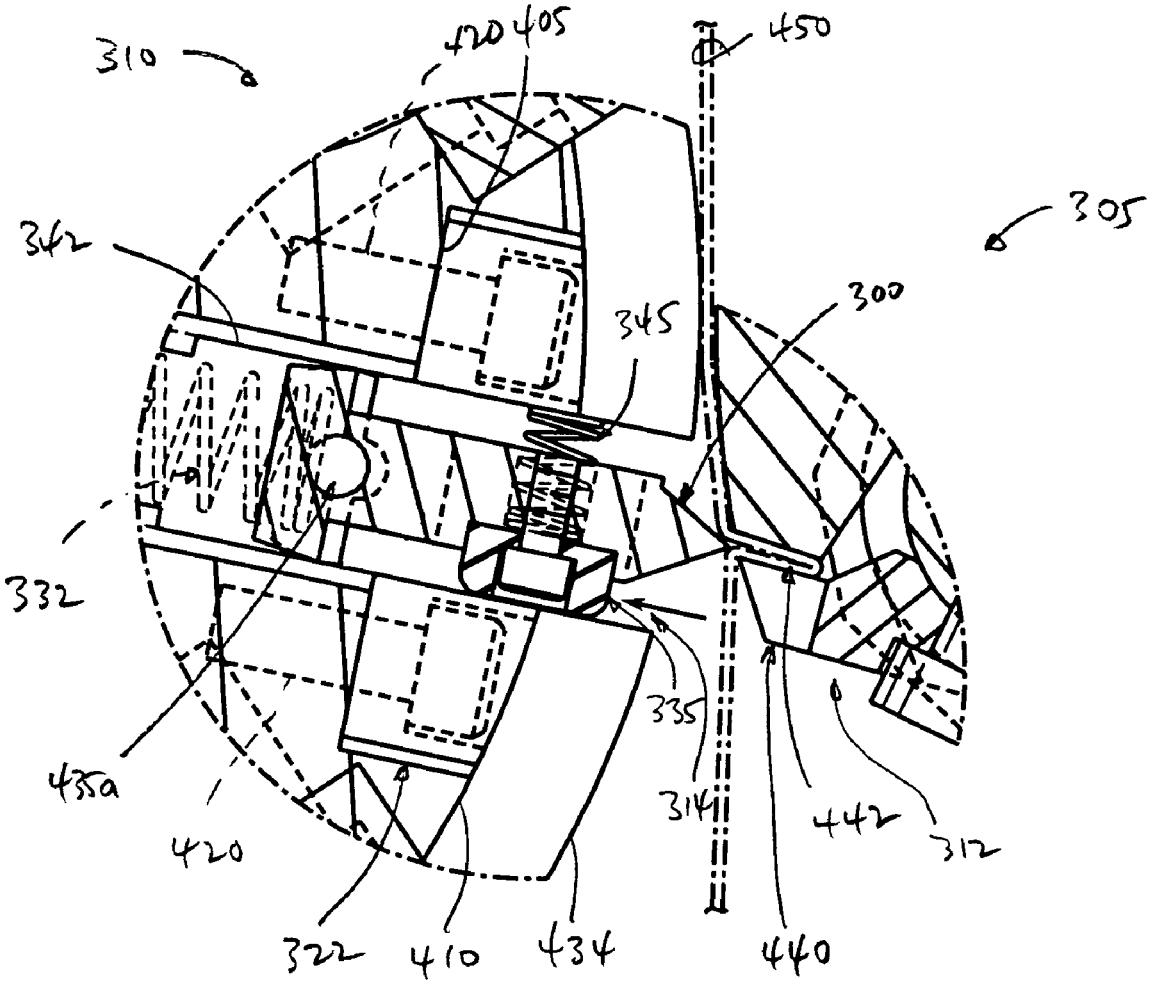
FIG. 22 is an enlarged detailed cross-sectional view of the tucker assembly shown in FIG. 20.

Tucker assembly 300 is generally mounted in a slot 314 (FIGS. 20-22) in the folding roll 310. It is understood that the tucker assemblies 300 of the adjacent folding roll 305 are constructed in a similar manner. Tucker assembly 300 generally includes a tucker element 315 that cooperates with gripper assemblies 312 in a similar manner as tucker element 125 as gripper assemblies 100, described previously, to form a crease or fold in a sheet of material, shown at 450. Tucker assembly 399 further includes a first tucker cap 320 and a second tucker cap 322, a first pin 325 and a second pin 326, a first slot spring 330 and a second slot spring 332, a bumper 335, a first cartridge 340 and a second cartridge 342, and a pivot spring 345. The first cartridge 340 and the first pivot spring 330 are positioned to interface with the tucker cap 320, and the second cartridge 342 and the second pivot spring 332 are positioned to interface with tucker cap 322. The tucker element 315, the first and second pins 325 and 326, and the first and second cartridges 340 and 342 are installed in the slot 314 and retained against the bias of the first and second slot springs 330 and 332 by the tucker caps 320 and 322.

In the illustrated embodiment, tucker element 315 includes a pointed end 355, a midsection 360, and a base portion 365. The pointed end 355 of the tucker element 315 is configured to interface with the gripper assembly 312. Tucker element 315 includes a first recess 370 that extends inwardly from pointed end 355. A first opening or passage 375*a* and a second opening or passage 375*b* extend axially inwardly from the opposite ends of tucker 310, and receive inner portions of the pins 325 and 326, respectively. The outer end portions of pins 325, 326 extend outwardly of the ends of base portion 365. The tucker element 315 further includes a recess 380 in one of the faces 385 of the midsection 360 to receive the pivot spring 345, and another recess 390 in an opposite face 395 of the midsection 360 to receive the bumper 335. The location of the pivot spring 345 and bumper 335 and their respective recesses 380 and 390 can vary. The bias of the pivot spring 345 against the bumper 335 is operable to radially align the tucker element 315 in the center of the slot 314. The bumper 335 and the pivot spring 330 also act to minimize bounce in the tucker element 315.

The tucker caps 320 and 322 function to retain the tucker element 315 in the slot 314. Tucker caps 320 and 322 engage the outer ends of base portion 365, and include inner faces 395 and 396 and an outer faces 400 and 402, respectively. The inner faces 395 and 396 are configured to interface with the ends of base portion 365 of the tucker element 315 and an inner surface 405 of the roll 310. The outer faces 400 and 402 of the cap 320 are configured with an arcuate shape that matches an arcuate outer surface 410 of the roll 310. The caps 320 and 322 are secured to the roll 310 with one or more fasteners 420. The type and number of fasteners 420 can vary.

The pins 325 and 326 are forced against the respective caps 320 and 322 by the slot springs 330 and 332 and cartridges 340 and 342, respectively. The outer end portions of pins 325 and 326 protrude in an axial outward direction from the tucker element 315 and engage respective slot portions 424 and 426 defined by the caps 320 and 322, respectively. With this arrangement, the tucker element 315 pivots about a pivot axis defined by the pins 325 and 326. The outer end portions of pins 325 and 326 occupy approximately half the full length of slot portions 424 and 426 defined by respective caps 320 and 322, and a pin of an adjacent tucker element takes up the remaining portion of the length of slot portions 424 and 426, respectively, to pivotably mount the adjacent tucker element in the same manner. The length and size of the pins 325 and 326 can vary.

The cartridges 340 and 342 are centrally located within the slot 314. In the illustrated embodiment, the cartridges 340 and 342 each are generally cylindrical structures having respective top surfaces 428 and 429 that define respective slots 432 and 433 to receive the pins 325 and 326, respectively. The cartridges 340 and 342 and respective slot springs 330 and 332 bias the tucker element 315 in a radial outward direction with respect to a circumference 434 of the folding roll 310. The caps 320 and 322 retain the tucker element 315 in the slot 314 against the bias of the cartridges 340 and 342 and respective slot springs 330 and 332.

The tucker element 315 further includes a pair of openings 435*a* and 435*b* that extend through the midsection 360 and above the base portion 365. The openings 435*a* and 435*b* receive fasteners (not shown) to hold the pins 326 and 326 in position on the tucker element 315.

In operation, as the folding roll 310 rotates with an adjacent folding roll 305, the tucker element 315 interfaces with the gripper assembly 312 of the adjacent roll 305. As the tucker element 315 approaches a blade 440 and anvil 442 of the gripper assembly 312, the pointed end 355 of tucker element 315 engages a sheet 450, and moves the sheet 450 into contact with the anvil 442 of the adjacent gripper assembly 312. The contact of the tucker element 315 against the anvil 442 forces the tucker element 315 to pivot slightly forward against the bumper 335. As the folding roll 310 continues to rotate, the tucker element 315 moves in the opposite direction against the force of pivot spring 345. The blade 440 of the adjacent gripper assembly 312 is moved against the anvil 442 to grip the sheet 450. As the folding roll 310 continues to rotate, the tucker element 315 retracts is retracted within slot 314 against the biasing force of springs 330 and 332, which facilitates disengagement of tucker element 314 from anvil 442 and sheet 450. The blade 440 clamps the sheet 450 against the anvil 442, and the pivoting and retracting movement of tucker element 315 functions to eliminate bounce that may otherwise occur in the folding process. The pivot spring 345 in combination with the bumper 335 then return the tucker element 315 to a centered position in the slot 314, and springs 330 and 332 return tucker element 315 to its fully extended position.

In the event the tucker element 315 contacts the outer surface of the adjacent folding roll 305 or anvil 442, tucker element 315 retracts within slot 314 against the outward bias of springs 330 and 332. Tucker element 315 and attached pins 325 and 326 retract in a radial inward direction within the slot 314. As the tucker element 315 and attached pins 325 and 326 retract inwardly, the pins 325 and 326 are moved out of engagement with the caps 320 and 322, and move inwardly against the bias of slot springs 330 and 332 along with cartridges 340 and 342, respectively. The retraction of the tucker element 315 along the slot 314 prevents the tucker element 315 from damaging the adjacent roll 305 and its associated components, and also prevents jams which may otherwise occur, in the event the of a disruption in the timing of the rolls and or deviations due to manufacturing or installation tolerances. Following retraction of the tucker element 315, the bias of the cartridges 340 and 342 and associated slot springs 330 and 332 along with the pivot spring 345 and bumper 335 act to return tucker element 315 to the extended position, and to self center the tucker element 315 in the slot 314.

It should be understood that the present invention contemplates any type of arrangement that provides pivoting movement of the tucker element relative to the folding roll, and is not limited to a pin-type pivot arrangement. For example, pivoting movement of the tucker element within the slot may be accomplished without a pivot pin by means of the base of the tucker engaging the slot edges, with the tapered area of the base accommodating pivoting movement of the tucker element. It is also to be understood that the present invention contemplates that the tucker element is at a predetermined orientation relative to the folding roll when the tucker element is in the extended position. While the predetermined orientation may be radially aligned, it is also understood that the predetermined orientation may also be angled or biased either forwardly or rearwardly within the slot.

A wide variety of machines or systems could be constructed in accordance with the invention defined by the claims. Hence, although the exemplary embodiments of a tucker assembly 20, 300 in accordance with the invention has been generally described with reference to an interfolding machine 25 for folding sheets 30 into an interfolded stack 32, the application of the tucker assembly 20, 300 is not so limited. The tucker assembly of the invention could be employed to fold any type of sheet or web material such as 30, for a wide variety of uses to machines and is not limiting on the invention.

The above discussion, examples, and embodiments illustrate our current understanding of the invention. However, since many variations of the invention can be made without departing from the spirit and scope of the invention, the invention resides wholly in the claims hereafter appended.

We claim:

1. A folding roll assembly, comprising:

a first rotating roll having an outer roll surface;

a second rotating roll having a gripper assembly;

a slot formed in the first rotating roll and extending inwardly from the outer roll surface, wherein the slot defines first and second spaced apart sidewalls;

a tucker element disposed in the slot;

a tucker element mounting arrangement interposed between the first rotating roll and the tucker element, wherein the tucker element is connected to the tucker element mounting arrangement via a pivot connection that provides pivoting movement of the tucker element about a pivot axis, and wherein the tucker element mounting arrangement is axially movable within the slot so as to provide axial inward and outward movement of the tucker element relative to the slot;

a spring carried by the first rotating roll and disposed in the slot, wherein the spring acts on the tucker element mounting arrangement, and wherein the spring and the tucker element mounting arrangement are configured and arranged to bias the tucker element toward a normal operating position in which the tucker element is biased axially outwardly relative to the slot and spaced from both the first and second sidewalls of the slot, wherein the tucker element defines an outer end located outwardly of the outer roll surface when the tucker element is in the normal operating position;

a retainer arrangement carried by the first rotating roll and configured to engage the tucker element mounting arrangement to retain the tucker element in the slot against the bias of the spring; and wherein, upon rotation of the first and second rolls, the tucker element of the first roll contacts the gripper assembly of the second roll and wherein the gripper assembly applies forces to the tucker element tending to cause the tucker element to move relative to the outer roll surface in at least one of the following directions: 1) away from the normal operating position in a first direction in which the tucker element is movable toward the first sidewall of the slot by pivoting movement of the tucker element about the pivot axis, 2) away from the normal operating position in a second direction toward the second sidewall of the slot by pivoting movement of the tucker element about the pivot axis, and 3) axially inwardly relative to the outer roll surface against the bias of the spring by inward movement of the tucker element mounting arrangement within the slot.

2. The folding roll assembly as recited in claim 1, wherein the retainer arrangement comprises a cap that engages a facing surface defined by the first rotating roll.

3. The folding roll assembly as recited in claim 1, wherein the pivot connection comprises a pivot arrangement including a pin that extends outwardly from the tucker element, wherein the pin is biased by the spring against the retainer arrangement.

4. The folding roll assembly as recited in claim 3, wherein the retainer arrangement comprises a cap that includes a slot portion to receive the pin.

5. The folding roll assembly as recited in claim 1, wherein the tucker element mounting arrangement includes a base portion on the tucker element opposite the outer end of the tucker element, and wherein the base portion includes a recess configured to receive the spring.

6. The folding roll assembly as recited in claim 5, wherein the pivot connection includes a pivot pin that extends outwardly from the tucker element, and wherein at least a portion of the pivot pin is received between a slot in the base portion of the tucker element and a slot portion defined by the retainer arrangement.

7. The folding roll assembly as recited in claim 1, wherein the tucker element mounting arrangement includes a roller engaged within the slot, wherein the roller guides axial movement of the tucker element within the slot and wherein the pivot connection is interposed between the tucker element and the roller.

8. The folding roll assembly as recited in claim 7, wherein the pivot connection includes a pair of outwardly extending pins that extend outwardly in opposite directions from the tucker element, and wherein the pins are received within passages defined by the tucker element, and wherein the tucker element includes first and second recesses within which first and second rollers are located, and wherein each pin is engaged with one of the rollers to provide pivoting movement of the tucker element relative to the rollers.

9. The folding roll assembly as recited in claim 1, wherein the pivot connection includes one or more pivot pins engaged with the tucker element, and wherein each of the pivot pins includes an outer portion that extends in a laterally outward direction from the tucker element.

10. A tucker arrangement for a folding roll having an outer roll surface, comprising:

a tucker element disposed within a slot defined by the folding roll and extending inwardly from the outer roll surface, wherein the slot defines first and second spaced apart sidewalls;

a tucker element mounting arrangement interposed between the folding roll and the tucker element, wherein the tucker element is connected to the tucker element mounting arrangement via a pivot connection that provides pivoting movement of the tucker element about a pivot axis, and wherein the tucker element mounting arrangement is axially movable within the slot so as to provide axial inward and outward movement of the tucker element relative to the slot;

a biasing arrangement carried by the roll and disposed within the slot, wherein the biasing arrangement acts on the tucker element mounting arrangement to bias the tucker element toward a normal operating position in which the tucker element is biased axially outwardly relative to the slot and spaced from both the first and second sidewalls of the slot, wherein the tucker element defines an outer end located outwardly of the outer roll surface when the tucker element is in the normal operating position, and wherein the tucker element is configured to retract radially inwardly within the slot against the bias of the biasing arrangement; and wherein the tucker element mounting arrangement is configured and arranged such that the tucker element is laterally movable relative to the outer roll surface about the pivot connection away from the normal operating position in a first direction toward the first sidewall of the slot, and in a second direction toward the second sidewall of the slot, and such that the tucker element is movable inwardly into the slot by axial movement of the tucker element mounting arrangement into the slot;

wherein the biasing arrangement and the tucker element mounting arrangement are configured to bias the tucker element for movement about the pivot axis toward the normal operating position, and to bias the tucker element outwardly, wherein the tucker element is movable against the biasing arrangement laterally away from the normal operating position and inwardly into the slot when an external force, generally opposite to the biasing force provided by the biasing arrangement, is applied to the tucker element.

11. The tucker arrangement of claim 10, wherein the tucker element mounting arrangement includes a roller arrangement located in the slot that is configured to move inwardly and outwardly within the slot, wherein the tucker element is interconnected with the roller arrangement via the pivot connection and the biasing arrangement is configured to bias the roller arrangement outwardly, and wherein the pivot connection comprises a pivot member secured to the tucker element and engaged with the roller arrangement for pivoting the tucker element about the pivot axis.

12. The tucker arrangement of claim 10, wherein the pivot connection includes a pivot member carried by the tucker element, and wherein the biasing arrangement includes a spring disposed within a cartridge, wherein the cartridge defines an end that engages the tucker element to provide pivoting movement of the tucker element about the pivot axis.

13. The tucker arrangement of claim 12, wherein the biasing arrangement includes a laterally oriented centering spring arrangement engaged with the tucker element for positioning the tucker element in the normal operating position within the slot.

14. The tucker arrangement of claim 10, wherein the biasing arrangement comprises a radial spring member that applies a radially outward force on the tucker element mounting arrangement, wherein the pivot connection provides movement of the tucker element about the pivot axis, and wherein the tucker element is biased for movement by the radial biasing arrangement about the pivot axis toward the normal operating position.

* * * * *